United States Patent [19]

Gottschlich

[11] 3,981,387

[45] Sept. 21, 1976

[54] METHOD FOR INKING PREASSEMBLED RIBBON CARTRIDGES

[75] Inventor: James A. Gottschlich, Bellbrook, Ohio

[73] Assignee: NCR Corporation, Dayton, Ohio

[22] Filed: Dec. 24, 1974

[21] Appl. No.: 536,133

[52] U.S. Cl. ..... 197/168; 156/73.4; 197/151; 197/171; 197/172; 242/55.19 A; 427/424; 427/429

[51] Int. Cl.[2] ..... B41J 33/10

[58] Field of Search ..... 197/171, 168, 151, 172; 427/424, 429; 242/55.19 A; 156/73.4

[56] References Cited

UNITED STATES PATENTS

| | | | |
|---|---|---|---|
| 1,304,367 | 5/1919 | Pullen | 197/171 |
| 2,793,153 | 5/1957 | Grundel | 197/172 |
| 3,086,901 | 4/1963 | Ploeger, Jr. | 197/168 X |
| 3,241,522 | 3/1966 | Knight | 197/171 X |
| 3,643,777 | 2/1972 | Anderson et al. | 197/151 |
| 3,804,227 | 4/1974 | Cappotto et al. | 197/151 |
| 3,814,231 | 6/1974 | Cappotto | 197/168 |
| 3,821,048 | 6/1974 | Acker et al. | 156/73.4 |

*Primary Examiner*—Paul E. Shapiro
*Attorney, Agent, or Firm*—J. T. Cavender; Albert L. Sessler, Jr.; Elmer Wargo

[57] ABSTRACT

A method which includes loading a length of uninked ribbon into a ribbon cartridge having a support area where a portion of the ribbon is supported and exposed; positioning an inking member and the portion of the ribbon exposed at said support area in operative proximity with each other; and driving said ribbon while in operative proximity with the inking member so as to transfer ink from said inking member to the length of ribbon.

14 Claims, 8 Drawing Figures

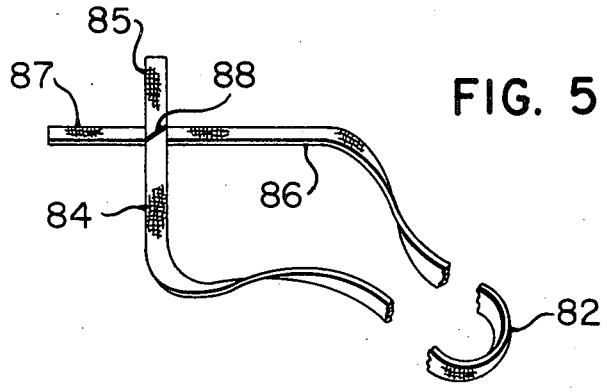
FIG. 5
FIG. 4
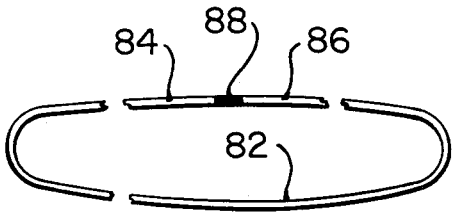
FIG. 6
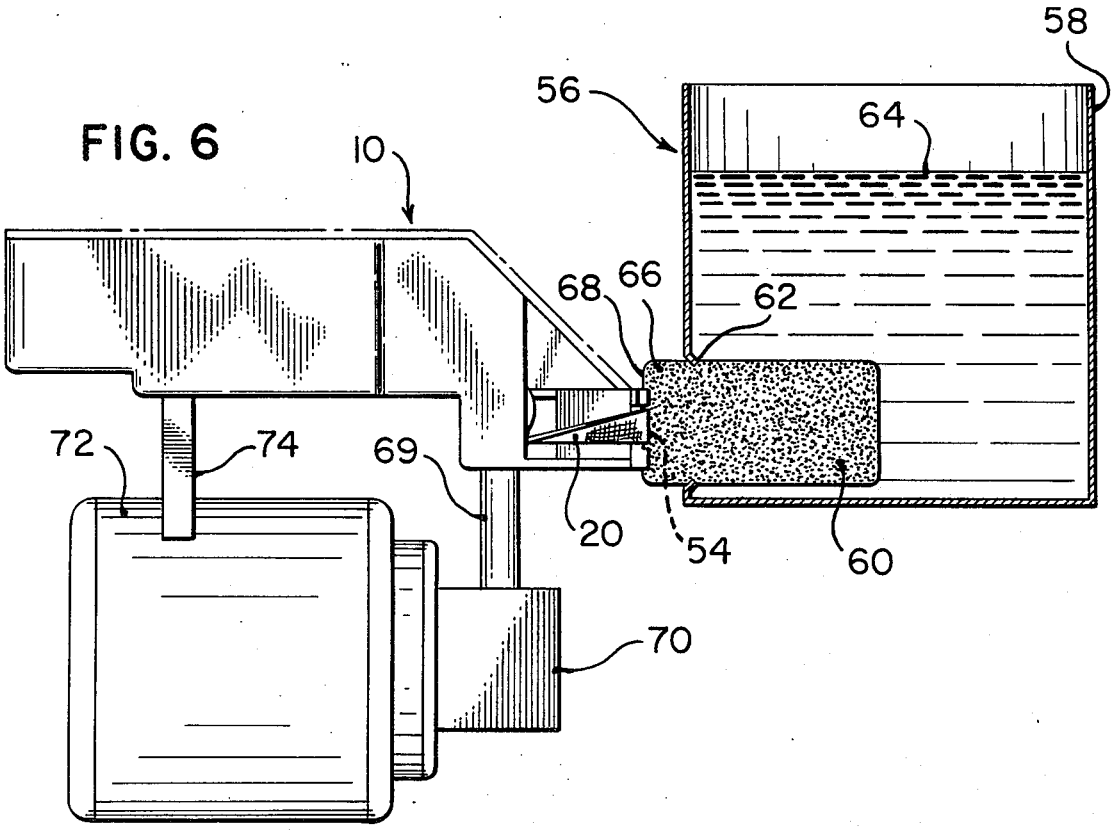

METHOD FOR INKING PREASSEMBLED RIBBON CARTRIDGES

BACKGROUND OF THE INVENTION

This invention relates to a method of producing inked-ribbon cartridges.

Recently, there has been a trend in the typewriter and business machine arts to incorporate an inked ribbon in a disposable cartridge or cassette which can be readily installed and/or replaced in such printing machines. The operator of one such machine merely removes the old cartridge when the ink in the ribbon is used up or the ribbon becomes frayed from use, and he installs a new cartridge without ever having to soil his hands by touching the ribbon itself. The cartridge usually has a feed means therein which cooperates with a driving member on the machine on which the cartridge is installed so as to transport the ribbon in the cartridge, and thereby present a fresh supply of inked ribbon to a print station located in the machine.

Some of the prior art ribbon cartridges employ two reels therein on which the ribbon is alternately wound and unwound as used. Other cartridges employ only one special reel on which an endless inked ribbon is wound, and as the reel rotates, the ribbon winds up on the "outer turn" of ribbon on the reel, and the ribbon is withdrawn therefrom by withdrawing the "innermost turn" of the ribbon from the reel. A third type of cartridge employs a length of about 15 yards of inked ribbon which is formed into an endless loop of ribbon which is not stored on any reel or reels within the cartridge, but is simply stuffed therein to produce many folds or convolutions in the ribbon. In this latter type of cartridge, the ribbon is simply fed into or "stuffed" into the cartridge by a feed means located at an entrance area thereof, and is pulled out of an exit area of the cartridge by the feed means as the ribbon is stuffed into the cartridge.

Some representative prior art, inked-ribbon cartridges and inking methods are shown in the following U.S. Pat. Nos.: 2,755,905; 2,878,751; 3,241,522; 3,643,779; 3,804,227; and 3,814,231.

One of the problems with producing the prior art ribbon cartridges is that the ribbon is inked prior to installing it in its associated cartridge. As a result, the cartridge itself and the hands of the operator who is installing the ribbon in the cartridge become smeared with ink, requiring extensive clean-up time for cleaning both the assembled cartridge and the operator's hands.

Another problem with producing prior art ribbon cartridges relates to producing cartridges including a length of inked ribbon which is formed into an endless loop. Because of the ink being in the ribbon at the time of forming an endless loop, an effective or lasting bond joining the ends of the length of ribbon is difficult to obtain, thereby subjecting the ribbon to potential failure at the bond. The utilization of pre-inked ribbon fabric also limits the number of bonding techniques which may be utilized to join the ends of a ribbon.

SUMMARY OF THE INVENTION

In contrast with the above, the method of this invention entails loading an uninked or dry ribbon into a cartridge and inking the ribbon after it is installed in the cartridge, eliminating the messy operations which result from handling an inked ribbon. Because the loading of the ribbon is effected in a dry or uninked state, a better bond of the ribbon, when formed into an endless loop, is made possible. After the uninked ribbon is loaded in the cartridge, an inking means and a portion of the ribbon exposed from the associated cartridge are brought into operative proximity with each other, and the ribbon is driven so as to transfer ink from the inking means to the length of ribbon in the cartridge.

An inherent advantage of the method of this invention is that the cartridge with the uninked ribbon therein may be stored in this condition until orders are received for a particular color or type of ink. Thereafter, the particular ink can be applied to the ribbon in the cartridge to fill the order, thereby minimizing the number of cartridges of different colored or types of inks which must be stored. This method also eliminates the problem of inked ribbon cartridges "drying out" when stored in an inked condition for an extended period of time.

These and other advantages of the method of this invention will be more fully realized by referring to the following description and claims in conjunction with the accompanying drawing.

BRIEF DESCRIPTION OF THE DRAWING

FIG. 4 is a side view showing the joined ends of a ribbon joined by the apparatus shown in FIG. 3 after flattening to form a butt seam;

FIG. 5 is a perspective view of a length of uninked ribbon whose ends are joined together along a 45 degree angle;

FIG. 6 is a side view, in elevation, showing additional details of a cartridge being inkedd by a felt inking member of the inking means shown in FIG. 1;

DETAILED DESCRIPTION OF THE INVENTION

Figure 1:
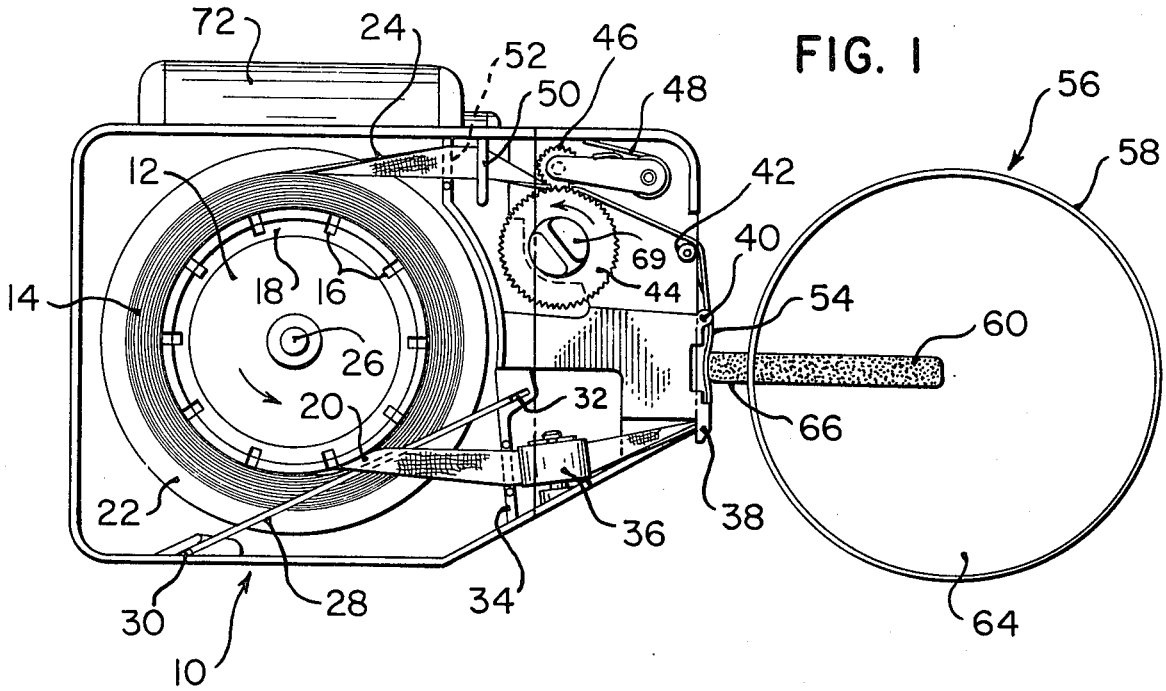
FIG. 1 is a plan view of one type of ribbon cartridge which may be produced by the method of this invention, showing an inking means in operative proximity with a portion of an uninked ribbon which is exposed from the cartridge and supported thereby during the inking of the ribbon.

FIG. 1 shows a plan view of a prior art type of ribbon cartridge designated generally as 10 and which cartridge may be produced or assembled according to the method of this invention.

Figure 2:
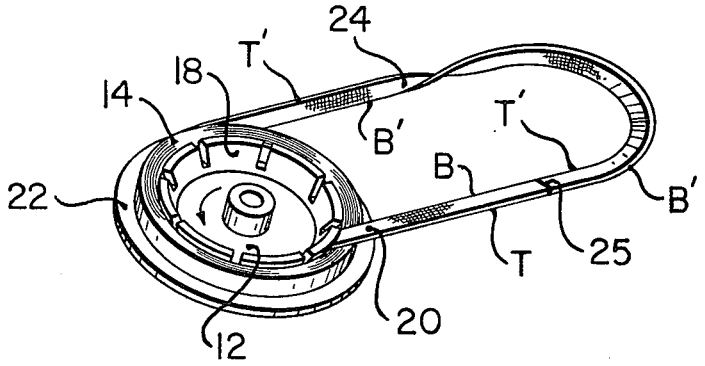
FIG. 2 is a perspective view of a reel of uninked ribbon used in the cartridge of FIG. 1 showing a length of ribbon which is joined together to form an endless loop.

The cartridge 10 includes a single reel 12 on which a length of about 15 yards of uninked ribbon 14 is wound. Prior to winding the ribbon 14 on the reel 12, the innermost end of the length of ribbon is inserted in one of the slots 16 of the core 18 of the reel 12 so that the innermost turn 20 of the ribbon can be later pulled out as shown in FIG. 2. The reel 12 has a single flange 22 to support the ribbon 14, and the outer turn 24 and the innermost turn 20 of the ribbon 14 are joined together in a seam 25 (by means to be later described herein) as shown in FIG. 2. The innermost turn 20 of the ribbon 14 has a top edge (T) and a bottom edge (touching the flange 22 and marked B), and the outer turn 24 has a top edge (T') and a bottom edge (B') as shown in FIG. 2. The outer turn 24 is given a half turn in a clockwise direction as viewed in FIG. 2 prior to joining it to the innermost turn 20 at the seam 25 so that when the ribbon is in use in the cartridge 10, each side of the ribbon will be alternately presented for use in a machine in which the cartridge 10 is used.

The reel 12 with the ribbon 14 thereon is rotatably mounted on a pin 26 in the cartridge 10 as shown in FIG. 1. The innermost end 20 of the ribbon 14 glides over a rod 28 which is detachably, press fitted into complementary notches 30, 32 in the cartridge 10. The rod 28 facilitates withdrawing the innermost turn 20 of the ribbon from the reel 12. From the rod 28, the innermost turn 20 of the ribbon glides over a support 34 and under a roller 36 to spaced, parallel supports 38, 40 which enable the ribbon to be supported therebetween in a print plane, and exposed for use in printing. From the support 40, the innermost turn 20 passes around a roller 42 and is fed between a feed gear 44 and idler gear 46 which is spring-biased into engagement with the feed gear 44 by a spring 48. From the feed gear 44, the innermost turn 20 passes under a support 50 and over a support 52 where the innermost turn 20 becomes the outer turn 24 on the reel 12. As the feed gear 44 is rotated (by means to be later described) the innermost turn 20 of the ribbon is pulled from the reel 12 causing it to turn in a counterclockwise direction (as viewed in FIG. 1) causing the outermost turn 24 of the ribbon to wind on the reel 12.

With the dry or uninked ribbon 14 being loaded in a cartridge 10 as described, the ribbon 14 is ready for inking. In order to ink the ribbon 14, the portion of the ribbon which is exposed and supported by the cartridge 10, as at area 54, (FIG. 1) is positioned in operative proximity with an inking means designated generally as 56.

The inking means 56 in the embodiment shown includes a reservoir 58 having an inking member 60 located near the bottom thereof as shown in FIG. 6. The inking member is inserted through a tight hole 62 in the reservoir 58 and mounted so that a portion of the member 60 is in contact with the ink 64 in the reservoir and a portion 66 of the member 60 lies outside the reservoir 58. The portion 66 of the member 60 has a face 68 which is generally planar and has chamfered edges to facilitate the movement of the ribbon 14 therepast as it is driven. In the embodiment shown in FIGS. 1 and 6, the inking member is made of SAE F-5 felt, and the ink used is K814 oil-based purple or K816 oil-based red manufactured by NCR Corporation of Dayton, Ohio. Naturally, the type of ink 64 and the inking member 60 selected for use will depend upon the particular type or color of ink or inks which are to be applied to the ribbon in the cartridge 10. Because the selection of inks and inking members 60 may be conventional, no further discussion thereof is deemed necessary.

With the exposed area 54 (of the ribbon 14 in the cartridge 10) and the inking means 56 in operative proximity with each other, the ribbon 14 is driven so as to transfer the ink from the inking means 56 to the ribbon 14. The ribbon 14 of the cartridge 10 is driven by a driving shaft 69 which is in driving engagement with the feed gear 44 to rotate it in the direction shown in FIG. 1. The shaft 69 is rotated by a gear reduction unit 70 which is operatively connected to the output shaft of a motor 72. In the embodiment shown, the motor 72 and gear reduction unit 70 drive the feed gear 44 at a speed of approximately 280 RPM to thereby drive the ribbon 14 past the inking member 60 at a linear speed which enables the entire length of ribbon of about 50 feet to cycle past the inking member 60 in about 20 seconds. The ribbon 14 is continually driven past the inking member 60 until the ribbon is satisfactorily inked; generally, cycling the entire length of ribbon 14 past the member 60 about five times will produce satisfactory inking. Generally, the tension on the ribbon 14 (at the area 54) during the time that the ribbon is being driven, is sufficient to hold the ribbon in contact with the face 68 of the inking member 60; however, a conventional, back-up, roller (not shown) placed behind the ribbon at area 54 in opposed relationship with the inking member 60 may be used to facilitate the inking process if found necessary.

During the time that ribbon 14 is being driven by the motor 72, the cartridge is supported and held on the motor 72 by any conventional support or holding means 74. After the entire length of ribbon 14 is inked, the cartridge 10 is removed from the shaft 69 and the inking means 56.

Figure 7:
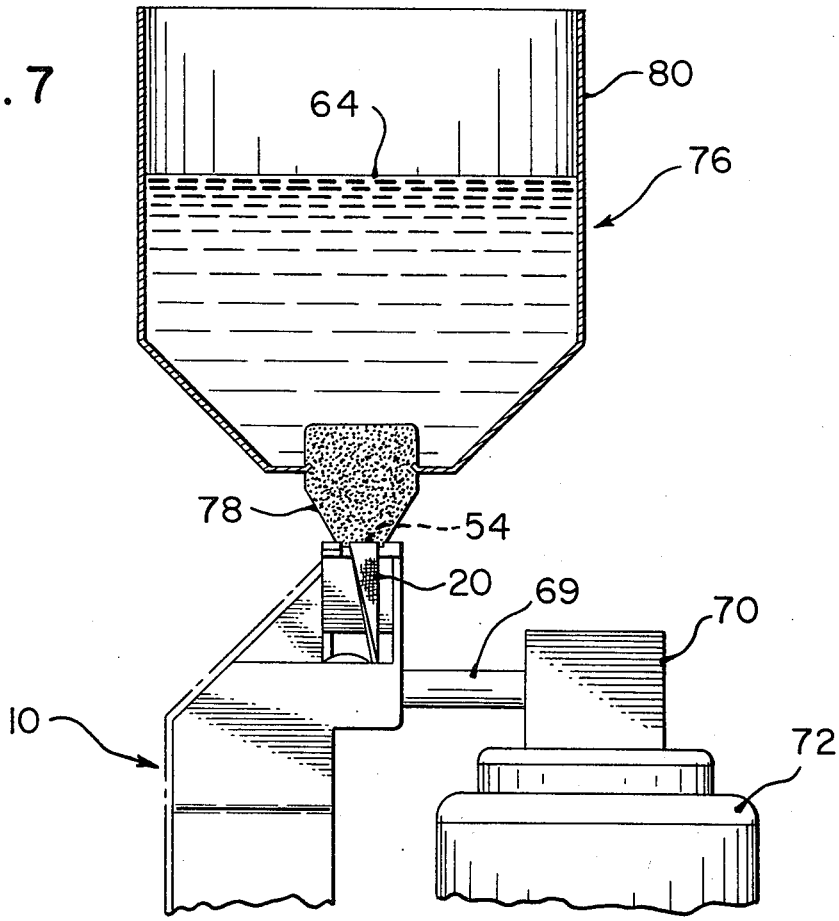
FIG. 7 is an elevational view showing the ribbon of a cartridge being inked by locating the area of the ribbon exposed for inking in a horizontal plane, with the cartridge being located beneath an inking means.

In some situations, it may be desirable to orient the cartridge 10 so that the exposed area 54 of ribbon lies in a substantially horizontal plane as shown in FIG. 7 and to position the exposed area 54 of ribbon under an inking means designated generally as 76 to transfer the ink from the inking means 76 to the ribbon. The inking means 76 is substantially identical to the inking means 56 already described; however, the inking member 78 thereof is located in the bottom of the reservoir 80 to extend out of the bottom of the reservoir 80 instead of out of a side of the reservoir 58 is shown in FIG. 6. The technique for inking the ribbon with the apparatus shown in FIG. 7 is the same as that already explained in relation to FIGS. 1 and 6; however, the apparatus shown in FIG. 7 has the advantage of spreading the ink more evenly over the width of ribbon in the cartridge 10 than the apparatus shown in FIGS. 1 and 6.

While the method of producing an inked ribbon cartridge has been described in relation to a cartridge 10 (FIGS. 1 and 2) of the single reel type, the same techniques can be applied to ribbon cartridges of the stuffed ribbon type shown in U.S. Pat. No. 3,814,231, and the twin reel type shown in U.S. Pat. No. 3,804,277 which are incorporated herein by reference. Because the exact nature of the construction of the cartridges shown in these two named patents is not important to the method of this invention, it is sufficient to state that each cartridge shown in these patents has a portion of the ribbon of the cartridge exposed and supported by the cartridge (for placing the exposed ribbon in operative proximity with an inking means) and a means for driving the ribbon by a driving member (similar to 69 in FIG. 6) which passes through the cartridge to engage a ribbon feeding or driving means therein.

When the method of this invention is employed on a cartridge of the stuffed ribbon type, a length of about 15 yards of uninked ribbon 82 is stuffed into the cartridge to produce a plurality of convolutions or folds of the ribbon in the cartridge, and the ends of the ribbon like 84 and 86 shown in FIG. 5 are bonded together by any conventional bonding technique to produce a seam 88. The seam 88 may be one which is formed along a 45 degree angle as shown. Thereafter, the short ends 85 and 87 are trimmed off and the ends 84 and 86 are aligned with each other and flattened to produce the flattened seam 88 (FIG. 4) having substantially the same thickness as the ribbon 82. As far as the method of this invention is concerned, the seam 88 may be formed prior to stuffing the ribbon 82 into its associated cartridge.

As alluded to earlier herein, the bonding of the ends of the ribbon may be effected by ultrasonic bonding. One such appartus for bonding the ends of a ribbon is shown in FIG. 3.

The bonding apparatus (FIG. 3) designated generally as 90 includes an ultrasonic horn 92 equipped with a suitable cutting and welding tool 94 which is adapted to coact with an anvil or table 96 to perform cutting and welding operations on an uninked ribbon 14 made of a resilient plastic material like nylon. As is well known, ultrasonic plastic bonding is accomplished by the compression and decompression of plastic material at ultrasonic speeds. The apparatus 90 also includes a transducer 98 and conventional positioning means 100 for raising, lowering, and moving the welding tool 94 relative to the ribbon 14 and for holding it in raised and lowered positions. A suitable, conventional transducer 98 may be used, and one such transducer which has been satisfactory for use in the apparatus 90 is Model No. 302 which is manufactured by Ultrasonic Systems, Inc., of Farmingdale, New York.

Figure 3:
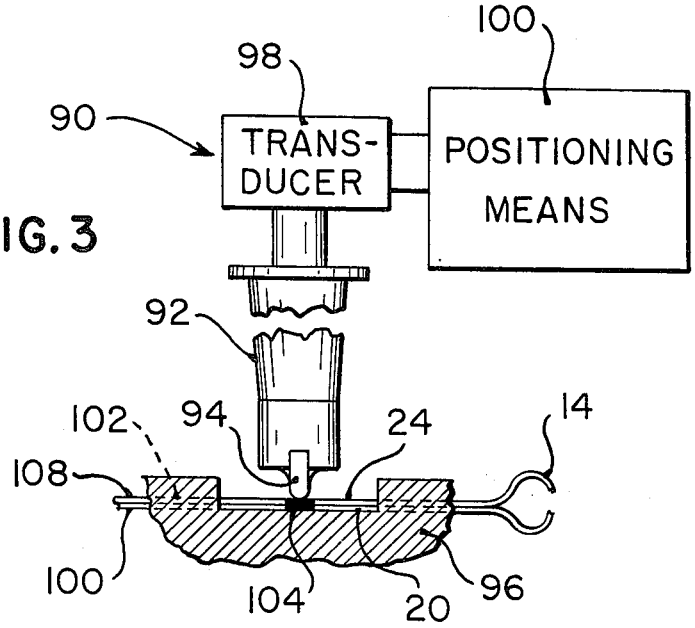
FIG. 3 is a side view in elevation, showing an apparatus or a means for joining the ends of an uninked ribbon to form an endless loop.

To effect a bonding of the uninked ribbon 14, the ends 20, 24 of the ribbon 14 are placed in a slot 102 in the table 96 and aligned one on top of another as shown in FIG. 3, and held therein by conventional means (not shown). In one embodiment, each end 20, 24 of the ribbon 14 is 0.004 inch thick to make a total thickness of 0.008 inch when positioned on the surface of the table 96. The cutting tool 94 is then lowered on the two ends 20, 24 of the ribbon by the positioning means 100 to a point 0.003 inch above surface of table 96 to compress the ends of the ribbon 62.5 percent. When the transducer 98 is energized, the positioning means 100 advances the tool 94 from one edge of the ribbon to the other in a direction which is transverse to the length of the ribbon 14. When energized, the transducer 98 causes the tool 94 to vibrate at a frequency of 20,000 cycles per second to produce a "hammering effect" having a stroke of one to 0.004 inch. The hammering effect fuses the ends 20, 24 of the ribbon 14 together to form a seam 104 and also cuts off the short ends 106 and 108, respectively. The joined ends 20, 24 of the ribbon are then removed from the table 96 and spread out as shown by the ribbon 82 in FIG. 4, and the seam 104 is flattened by the use of a conventional flattening tool to form it into a butt seam similar to seam 88 shown in FIG. 4. Because the welding techniques employed in this invention may be conventional, they are not described in further detail.

Figure 8:
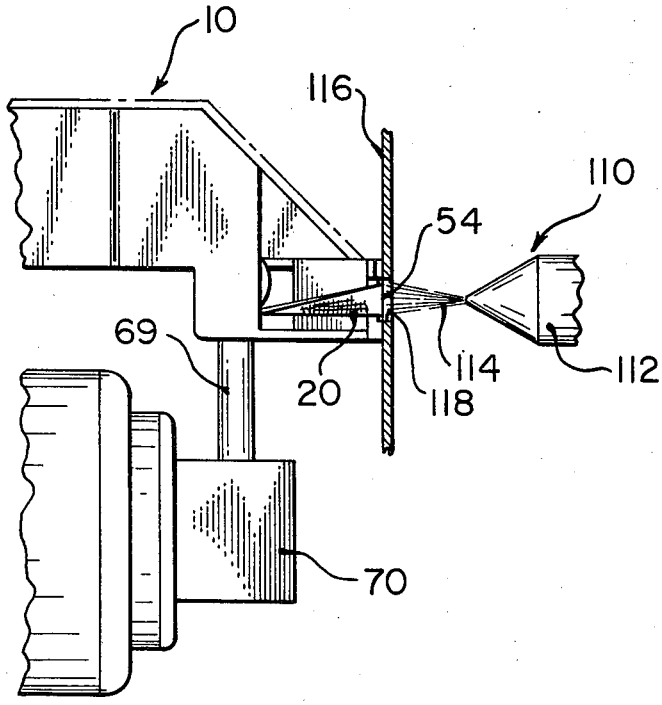
FIG. 8 is a side elevational view similar to FIG. 6, showing a different inking means in operative proximity with the exposed area of ribbon to be inked.

An additional inking means which may be utilized in the method of this invention is shown in FIG. 8 and is designated generally as 110. The inking means 110 and the ribbon cartridge 10 are positioned so that the portion of the ribbon exposed (area 54) and supported by the cartridge 10, and the inking means 110 are in operative proximity with each other as shown. The inking means 110 includes any suitable conventional spraying device, shown schematically only as a spray nozzle 112, having its spray 114 of ink directed at the exposed area 54 of the ribbon. A suitable shield 116 positioned between the nozzle 112 and the cartridge 10 and having a rectangular hole 118 therein, permits the ribbon to be sprayed with ink but protects the cartridge 10 from being sprayed. As the ribbon area 54 is being sprayed, a driving shaft 69 identical to that shown in FIG. 6 drives the ribbon in the cartridge 10 to effect a complete inking of the ribbon stored therein.

One of the advantages of the method of this invention is that a dry or uninked ribbon may be loaded into a cartridge and stored until a decision is made as to the color or type of ink to be applied to the ribbon in the cartridge. Thereafter, the cartridge is removed from storage and inked with the color or type of ink selected. This method reduces the number of cartridges of different ink ribbons which must be kept in inventory and also eliminates of the problem of the ink drying out of the ribbon when stored for extended periods of time.

While the method disclosed herein relates primarily to inking a ribbon with one color or type ink, it would be obvious to one skilled in the art that the same techniques disclosed herein can be extended to ink a ribbon which employes two different colors or types of inks. For example, after inking the top half of the ribbon with a red ink the lower half of the ribbon may be inked with a black ink.

An inherent advantage of the method of this invention lies in the fact that when the ribbon is driven to effect the inking of the ribbon, the ribbon is generally driven at speeds which approximate the speeds at which the ribbon will be driven when the associated cartridge is utilized in a business machine. Driving the ribbon at such speeds tends to stabilize the tensions on the ribbon which developed when it was first loaded into the cartridge, so as to produce a cartridge with the tension on the ribbon stored therein being stabilized.

What is claimed is:

1. A method of producing an inked ribbon cartridge comprising the steps of:

a. loading a length of uninked ribbon into a ribbon cartridge having a support area where a portion of the ribbon is supported and exposed;

b. positioning an inking means and the portion of the ribbon exposed at said support area is operative proximity with each other; and c. driving said ribbon while in operative proximity with said inking means so as to transfer ink from said inking means to said length of ribbon;

said loading step (a) comprising the steps of:

d. winding said length of said ribbon on a single reel; and e. joining the ends of said length of ribbon to form an endless loop to produce a cartridge of the type which employs a single reel from which the ribbon is unwound by withdrawing the innermost turn of the ribbon on the reel.

2. The method as claimed in claim 1 in which said joining step (e) is effected by ultransonic bonding.

3. The method as claimed in claim 1 in which said positioning step (b) comprises contacting said portion of said ribbon with an inking member of said inking means.

4. The method as claimed in claim 1 in which said positioning step (b) comprises the steps of:

f. orienting said cartridge so that said exposed portion of the ribbon lies in a substantially horizontal plane; and g. positioning said exposed portion of ribbon under said inking means.

5. A method of producing an inked ribbon cartridge comprising the steps of:

a. loading a length of uninked ribbon into a ribbon cartridge having a support area where a portion of the ribbon is supported and exposed;

b. positioning an inking means and the portion of the ribbon exposed at said support area in operative proximity with each other; and c. driving said ribbon while in operative proximity with said inking means so as to transfer ink from said inking means to said length of ribbon;

said loading step (a) comprising the steps of:

d. stuffing said length of ribbon in said cartridge to produce random convolutions in the ribbon stored in the cartridge; and e. joining the ends of said length of ribbon to form an endless loop to produce a cartridge of the stuffed-ribbon type.

6. The method as claimed in claim 5 in which said joining step (e) is effected by ultrasonic bonding.

7. The method as claimed in claim 5 in which said positioning step (b) comprises contacting said portion of said ribbon with an inking member of said inking means.

8. The method as claimed in claim 5 in which said positioning step (b) comprises the steps of:

f. orienting said cartridge so that said exposed portion of the ribbon lies in a substantially horizontal plane; and g. positioning said exposed portion of ribbon under said inking means.

9. A method of producing an inked ribbon cartridge comprising the steps of:

a. loading a length of uninked ribbon into a ribbon cartridge having a support area where a portion of the ribbon is supported and exposed;

b. placing said cartridge in storage after said loading step (a) is completed;

c. selecting a specific type or color of ink to be applied to the ribbon in said cartridge;

d. withdrawing said cartridge from storage;

e. positioning an inking means containing the type or color of ink selected in selecting step (c) and the portion of the ribbon exposed at said support area of the cartridge of step (d) in operative proximity with each other; and f. driving said ribbon while in operative proximity with said inking means so as to transfer ink from said inking means to said length of ribbon.

10. The method as claimed in claim 9 in which said positioning step (e) comprises contacting said portion of said ribbon exposed with an inking member of said inking means.

11. The method as claimed in claim 9 in which said positioning step (e) comprises the steps of:

g. orienting said cartridge so that said exposed portion of the ribbon lies in a substantially horizontal plane; and h. positioning said exposed portion of ribbon below said inking means.

12. The method as claimed in claim 9 which said loading step (a) includes the step (f) of joining the ends of said ribbon to form an endless loop.

13. The method as claimed in claim 12 in which said joining step (f) is effected by ultrasonic bonding.

14. The method as claimed in claim 9 in which said positioning step (e) comprises operatively spacing said portion of ribbon from an ink spray nozzle of said inking means for spraying ink on said portion of ribbon.

* * * * *

UNITED STATES PATENT OFFICE

CERTIFICATE OF CORRECTION

Patent No. 3,981,387 Dated September 21, 1976

Inventor(s) James A. Gottschlich

It is certified that error appears in the above-identified patent and that said Letters Patent are hereby corrected as shown below:

Column 6, line 43, "is" should be --in--.

Signed and Sealed this

Tenth Day of May 1977

[SEAL]

*Attest:*

RUTH C. MASON
*Attesting Officer*

C. MARSHALL DANN
*Commissioner of Patents and Trademarks*